United States Patent [19]

Hyland et al.

[11] 4,154,661

[45] May 15, 1979

[54] LOWERMOST BIPOLAR SPACING FOR ELECTROLYTIC CELL

[75] Inventors: Wayne W. Hyland, Lower Burrell; Robert F. Robl, Jr., Monroeville; Alfred F. LaCamera, Level Green, all of Pa.

[73] Assignee: Aluminum Company of America, Pittsburgh, Pa.

[21] Appl. No.: 909,826

[22] Filed: May 26, 1978

[51] Int. Cl.[2] ..... C25C 3/00; C25C 3/06

[52] U.S. Cl. ..... 204/64 R; 204/67; 204/244; 204/245

[58] Field of Search ..... 204/64 R, 67, 244 R, 204/245

[56] References Cited

U.S. PATENT DOCUMENTS

| | | | |
|---|---|---|---|
| 3,755,099 | 8/1973 | Haupin | 204/67 |
| 4,071,420 | 1/1978 | Foster et al. | 204/67 |

*Primary Examiner*—Howard S. Williams
*Attorney, Agent, or Firm*—Elroy Strickland

[57] ABSTRACT

An electrolytic cell in which a terminal cathode and a bipolar electrode located immediately adjacent the cathode are spaced apart a distance greater than the height at which molten metal produced on the cathode will accumulate before the metal begins to run off the cathode. In this manner, shorting together of the cathode and the adjacent bipolar electrode by the accumulation of molten metal is avoided under both operating and standby conditions. Under standby conditions, using the heat produced by the resistance of the anode and cathode of the cell to the flow of electrical current directed therethrough, metal tends to accumulate on at least a portion of the cathode because of a potential (voltage) difference existing between a portion of the anode and a portion of the cathode.

2 Claims, 1 Drawing Figure

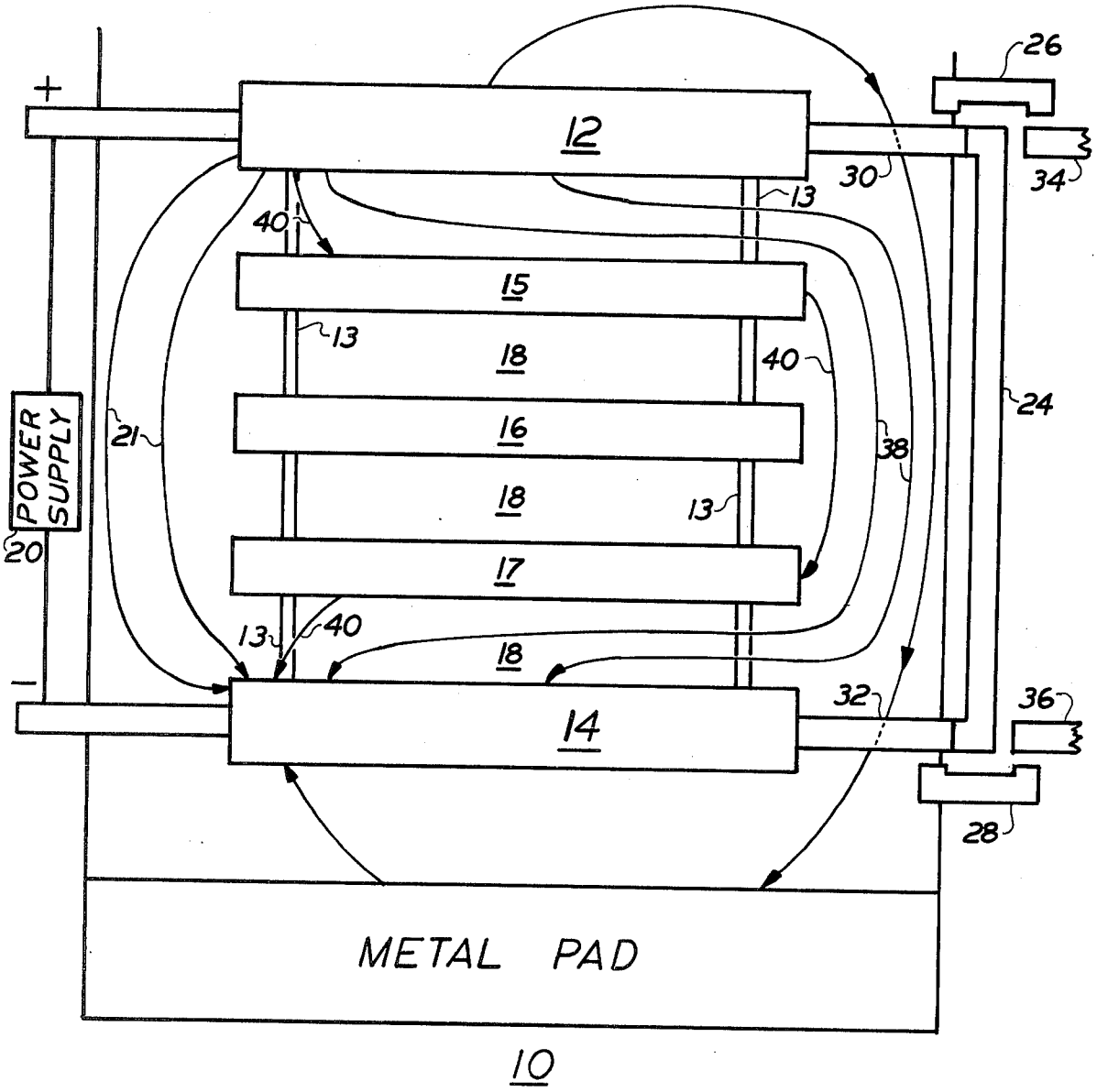
+
12
26
30
34
13
40
15
13
18
40
24
POWER SUPPLY
21
16
38
18
13
20
17
13
40
18
−
32
36
14
28
METAL PAD
10

LOWERMOST BIPOLAR SPACING FOR ELECTROLYTIC CELL

BACKGROUND OF THE INVENTION

The present invention relates generally to bipolar electrolytic cells for the production of metal, and particularly to a cell in which the accumulation of molten metal on the cathode of the cell will not short the cathode to the electrode immediately adjacent the cathode when the cell is operated in a standby, heating mode, as discussed below.

In U.S. Pat. No. 4,021,317 to Knapp et al, there is disclosed a method and apparatus for preheating or maintaining the heat existing in an electrolytic cell using the inherent resistance of the terminal cathode and/or anode of the cell. The patent discloses, in addition, a switching device for changing the cell from a mode in which metal is produced to the mode in which the cell can be heated using the resistance of its anode and cathode. Ordinarily, it is expected that the cell in a preheat or standby heat condition would not produce metal, as the conditions for producing metal are supposedly not prevalent, i.e., there is no electrical potential applied across the anode and cathode surfaces of the bipolar electrodes, which potential is necessary for decomposing a metallic compound in a solvent bath.

However, it has been found that when the anode and cathode are connected in electrical series with the power supply of the cell, and the cell contains an appropriate electrolyte, metal is produced on the cathode because of the voltage conditions that prevail in the cell, i.e., a potential difference is established between portions of the anode and cathode such that the electrolyte decomposes and metal is produced on at least that portion of the cathode surface exposed to the potential (voltage) difference.

It has further been found, for example, that in a quiescent electrolyte of aluminum chloride a drop of molten aluminum will grow to a height of about 1.59 centimeters (0.625 inches) when deposited on a flat, horizontal, graphite surface immersed in the electrolyte before the drop of aluminum begins to spread. Other metals behave in a similar manner, the maximum height of the metal on a non-wetting surface being dependent upon the difference between the surface tensions and densities of the metal and the electrolyte.

Ordinarily, in the operation of a cell in which the metal produced in bipolar compartments is swept from the compartments by gas generated in the compartments, such as shown and described in U.S. Pat. No. 3,822,195 to Dell et al, for example, the buildup of metal on the bipolars is not a problem. Under standby heating conditions similar to those described by Knapp et al in U.S. Pat. No. 4,021,317, it has been found, however, that little or no gas is generated in the interelectrode spaces near the terminal cathode; therefore, the sweeping of metal from these surfaces is inhibited. For this reason it is incumbent upon the designer of electrolytic cells, using superposed bipolar electrodes for the production of metal, to space the cathode and the next adjacent electrode a distance apart that is greater than the height at which the molten metal produced in the space will accumulate and build on the cathode before the metal begins to spread out and run off the cathode.

The adequacy of the dimension of this space is particularly important when a cell is placed in a mode for heating, using the resistance of the anode and cathode to the flow of electrical current as the source of heat. In such a mode, there is no generation of gas in the bipolar compartments such that there is no sweeping action across the surfaces of any of the electrodes to remove any metal on such surfaces. Any metal present on the cathode when the cell is changed to a heating mode is of course not swept away. The difference in potential between the anode and cathode when the cell is placed in a heating mode begins to produce metal on a portion of the cathode, as explained earlier. This metal is deposited upon any metal already existing on the cathode when the cell is changed to the heating mode such that the cathode can become shorted to the bipolar electrode immediately adjacent the cathode in a relatively short period of time, this time period depending upon the design, operating parameters and contents of the cell. When this occurs the bipolar and its compartment with the cathode are removed from operation which affects directly the efficiency and overall operation of the cell, as the cell is designed to operate, when producing metal, with a predetermined number of bipolars and compartments that share the potential imposed across the electrolytic bath. In this manner, a predetermined, proper potential is provided across each compartment for decomposing the electrolyte. In addition, when the cathode and the next adjacent bipolar short, this bipolar becomes the cathode for the cell and begins to accumulate metal itself. If the cell remains in standby condition a sufficient length of time, the metal collected on this bipolar will reach the next bipolar and electrically short the two together.

In U.S. Pat. No. 4,025,413 to Nightingale et al, the problem of slime collecting in the bottom of a tank for refining copper is discussed, the slime shorting adjacent, vertically oriented electrodes together. To cure the problem, the practice in that art had been to raise the electrodes from the bottom tank surface. This, however, as explained in the text of the patent, created other problems, the disclosure of the patent being directed to the use of vertically extending, insulating plates of a lattice work located below the electrodes to reduce current flow between the lower edges of the electrodes during the refining process.

SUMMARY OF THE INVENTION

The present invention is directed to a construction and operation of an electrolytic cell having a plurality of superposed electrodes and compartments for producing metal, with the compartment defined by the terminal cathode of the cell and the next adjacent electrode being provided with a space sufficient to prevent shorting of the cathode and the adjacent electrode by the accumulation of molten metal on the cathode when operating in the standby heating mode. This space is slightly larger than the height at which the molten metal will grow in the electrolyte and on the flat surface of the cathode until the metal spreads out and runs off the surface of the cathode. Such a space is also small enough so as to not effect adversely the operating efficiency (resistance) of the cell, and maintains proper distance between any metal on the cathode (held there by the surface tension of the metal) and the next adjacent electrode for the efficient production of metal, as explained in detail hereinafter.

THE DRAWING

The invention, along with its advantages and objectives, will best be understood from consideration of the following detailed description and the accompanying drawing in which the sole FIGURE thereof shows schematically a bipolar cell connected to provide resistance standby heating of the cell. The FIGURE also shows current flow lines existing within the cell due to the application of voltage for such resistant heating.

PREFERRED EMBODIMENTS OF THE INVENTION

Referring now to the drawing, the sole FIGURE shows schematically a bipolar electrolytic cell structure 10 having an upper terminal anode 12, a lower terminal cathode 14 and three superposed, spaced apart (by refractory, insulating posts 13), bipolar electrodes 15, 16 and 17 located between the anode and cathode. As such, the electrodes provide superposed, interelectrode spaces or compartments 18 for the production of metal when the cell contains a solvent and an oxide or salt of the metal, and a proper DC potential from a supply 20 (represented only diagrammatically in the FIGURE) is applied across the cell, via the anode and cathode, and divided evenly among the bipolars. The applied voltage is sufficient to decompose the metal ion in the interelectrode spaces 18 such that metal is produced on the cathode surfaces of electrodes 15, 16 and 17 and on the upper surface of cathode 14, while gas is produced on the anode surfaces of the electrodes.

The anode surfaces face in a downward direction in the structure depicted in the FIGURE. The cathode surfaces face in an upward direction, and such surfaces are planar and generally horizontal so that the metal produced on the cathode surfaces will tend to run off such surfaces.

When the cell 10 is placed in a standby heating condition, as shown in the present drawing, the anode 12 and the cathode 14 are connected in series with electrical supply 20, for the purpose of maintaining the temperature within the cell at the temperature at which the cell operates in its normal, metal producing mode. In standby, this temperature is maintained by using the resistance of the anode and cathode to the flow of electrical current therethrough. As is clear from the drawing, there is a difference in the voltage at the "entrance" ends of the anode and cathode, this difference being the voltage of 20, i.e., the positive potential (voltage) of 20 appears on the entrance end of anode 12 and a zero volt potential appears on the entrance end of cathode 14. Thus, a vertical voltage gradient is established, and a path for current flow is provided between the two electrodes in the bath of the cell, as indicated by solid lines 21 in the drawing. This current flow is effective to decompose the elements of the electrolytic bath of cell 10 to produce metal on the upper surface of the cathode.

In the drawing, cell 10 is shown connected to supply 20 in the heating mode by the use of a switch means 22, which, in the drawing, comprises a conducting bar 24 and end bars 26 and 28. These bars can be operated in the manner of the switch disclosed in the above U.S. Pat. No. 4,021,317 to Knapp et al to change cell 10 between an operating, metal producing mode and a standby, heating mode. For normal, metal producing operation, bar 24 is moved away from and out of contact with conductors 30 and 32, connecting the "exit" ends of the anode and cathode to the switch, and bars 26 and 28 are moved into contact with 30 and 32 to respectively connect 30 and 32 with leads or buses 34 and 36. Leads 34 and 36 are only partially shown in the FIGURE, but are connected respectively to the terminals of supply 20. In this manner, the voltage of 20 can be applied to both ends of the anode and cathode for the production of metal, as described in the above Knapp et al patent.

In standby condition, however, bar 24 connects (shorts) together the exit ends of anode 12 and cathode 14 so that current from 20 can be directed serially through the anode and cathode. Since 24 directly connects the exit ends together, the voltage at this end of the anode and cathode is the same. Thus, no voltage gradient exists between the exit ends of 12 and 14. However, in moving away from the exit ends of the anode and cathode and toward their entrance ends, voltage gradients appear and current flow through the bath of the cell takes place, as the voltages along the cathode tend toward zero, in moving toward the entrance end, while the voltages along the anode tend toward the maximum voltage of supply 20. Some current flows around the lefthand ends of the bipolar electrodes 15, 16 and 17 (in the FIGURE), as indicated by solid lines 38.

The anode and cathode generally equally divide the voltage of 20, with the voltage of each being generally equally divided along their length dimension. The division of voltage between the anode and cathode, of course, depends upon their relative electrical resistances.

The bipolar electrodes 15, 16 and 17 themselves, being physically separated from the anode and cathode by posts 13, and yet contained within the electrolytic bath of the cell, conduct very minimal current, with the bipolars immediately adjacent the anode and cathode conducting some lateral current, as indicated by solid lines 40. This current, however, is essentially zero.

As indicated earlier, the cell 10, when connected to produce metal in spaces 18, produces molten metal on the cathode surfaces of the bipolar electrodes 15, 16 and 17 and on the upper surface of cathode 14. Gas is generated on the anode surfaces of the bipolar electrodes, and this gas moves from said surfaces to flow upwardly and out of the cell. In so moving, the gas moves (sweeps) the metal produced on the cathode surfaces to the end of each electrode that is in the direction of gas movement so that the metal generally falls from such end to the bottom of the cell. The compartment formed by electrode 17 and cathode 14 operates similar to all other compartments and metal is swept from the compartment. However, once the cell 10 is placed in the standby heating mode, metal generated on a portion of the cathode surface is not swept therefrom, but generally builds to a predetermined thickness and then spreads out when the surface tension of the metal in the bath is no longer able to hold the metal beyond such thickness. Hence, the space between 14 and 17 should be greater than the height at which the metal will build before it begins to spread out and run off the cathode. Otherwise, if the space is too small, the metal will accumulate and short the lowermost bipolar electrode to the cathode, thereby changing the division of voltage across the cell, and thus the decomposition potential in spaces 18, which reduces the efficiency of the cell in the process of producing metal, as explained earlier.

Therefore in the standby heating mode any metal existing on the terminal cathode surface will remain, and metal will grow on the existing metal, because of the vertical voltage gradient 21 existing at the entrance ends of the anode and cathode, except for the inability of the molten metal to maintain a height greater than the force of its surface tension. If the metal collected on cathode 14 does short bipolar 17 to the cathode, bipolar 17 then begins to function as a cathode and will begin to build metal toward the next bipolar 16 immediately above 17. It is therefore imperative that the space between 14 and 17 be greater than the ability of the molten metal to build toward the lower surface of electrode 17. In the case of a cell designed to produce aluminum from aluminum chloride, the space should be greater than the ability of molten aluminum to build on a planar surface, which, as indicated above, is 1.59 centimeters. An adequate spacing for the lowermost compartment in a cell of the type shown in the above Dell et al patent has been found to be 1.91 centimeters or ¾ of an inch. The length of posts 13 in the space between 14 and 17 is such that this spacing is maintained. This spacing has been found not to unduly increase the electrical resistance in the bipolar space 18 between 17 and 14, as the molten metal on 14 reduces the space (again) to an appropriate physical dimension and electrical resistance, i.e., proper anode-to-cathode (A/C) spacing for efficient production of metal is maintained with a layer of molten aluminum of 1.59 centimeters on the cathode surface.

If an empty cell of the invention is preheated using the electrical resistance of 12 and 14, the above spacing is more than adequate to prevent shorting of 14 to 17, as there is now no quiescent electrolyte to assist the growth of metal droplets on the cathode.

While the invention has been described in terms of preferred embodiments, the claims appended hereto are intended to encompass all embodiments which fall within the spirit of the invention.

Having thus described the invention and certain embodiments thereof, what is claimed is:

1. In the operation of an electrolytic cell containing a molten electrolysis bath and a stack of superposed electrodes located in said bath, said electrodes including a terminal anode, a terminal cathode and at least one bipolar electrode located between the anode and cathode to provide interelectrode spaces for the production of metal, the operation comprising the steps of:

connecting the anode and cathode to a power supply in a manner that directs electrical current through the anode and cathode such that the internal, inherent resistance of the anode and cathode to the flow of the current will heat the anode and cathode and thereby heat the cell, producing molten metal on at least a portion of the cathode, and maintaining the space between the cathode and the bipolar electrode immediately adjacent the cathode a distance greater than the height at which molten metal will accumulate on the cathode and in the electrolysis bath before the molten metal begins to spread out and run off the cathode to avoid electrically shorting the immediately adjacent electrode and cathode together by the accumulation of molten metal on the cathode.

2. An electrolytic cell for electrolysis of a molten bath comprising a stack of superposed electrodes adapted to be located in said bath, said electrodes including a terminal anode, a terminal cathode and at least one bipolar electrode located between the anode and cathode to provide at least two superposed, interelectrode spaces for the production of metal, the anode and cathode having an internal, inherent resistance to the flow of electrical current directed therethrough, a supply of electrical power, means for connecting the anode and cathode to said supply in a manner that will direct electrical current through the anode and cathode such that the internal, inherent resistance of the anode and cathode to the flow of electrical current produces heat in the anode and cathode sufficient to heat the cell, the power supply providing voltage potentials on the anode that are effective to produce some molten metal on the cathode, means maintaining the interelectrode space between the cathode and the electrode immediately adjacent the cathode greater than the height at which the molten metal produced on the cathode and in the electrolysis bath will accumulate before the metal begins to spread out and run off the cathode, the maintenance of said space being effective to avoid shorting of the cathode and adjacent electrode together by the accumulation of molten metal on the cathode.

* * * * *